US005868565A

United States Patent [19]

Nowack

[11] Patent Number: 5,868,565

[45] Date of Patent: Feb. 9, 1999

[54] METHOD OF HEAT TREATING ARTICLES AND OVEN THEREFOR

[76] Inventor: William C. Nowack, P.O. Box 626, Twin Lakes, Wis. 53181

[21] Appl. No.: 877,487

[22] Filed: Jun. 17, 1997

[51] Int. Cl.[6] ..... F24F 9/00; F27B 9/02

[52] U.S. Cl. ..... 432/128; 432/64

[58] Field of Search ..... 432/64, 72, 121, 432/128, 144, 145, 152, 176

[56] References Cited

U.S. PATENT DOCUMENTS

| | | | |
|---|---|---|---|
| 2,126,534 | 8/1938 | Cope | 432/121 |
| 3,982,887 | 9/1976 | Kendziora et al. | 432/128 |
| 4,252,055 | 2/1981 | Johansson et al. | 432/121 |
| 4,298,341 | 11/1981 | Nowack | 432/64 |
| 4,627,814 | 12/1986 | Hattori et al. | 432/128 |
| 4,656,758 | 4/1987 | Nakayama | 432/152 |
| 4,846,669 | 7/1989 | Melgaard | 432/72 |
| 4,964,799 | 10/1990 | Hirano | 432/59 |
| 4,989,501 | 2/1991 | Catan | 126/110 R |
| 5,172,849 | 12/1992 | Barten et al. | 432/128 |

*Primary Examiner*—Teresa J. Walberg
*Assistant Examiner*—Gregory A. Wilson
*Attorney, Agent, or Firm*—Marshall A. Burmeister

[57] ABSTRACT

An industrial oven for heat treating a series of articles by transporting the articles through a heated tunnel in an enclosure, the enclosure having air barrier closures at the entrance and exit of the tunnel, the air barrier closure at the entrance of the tunnel having a blower with an inlet for receiving a gaseous medium and a nozzle for expelling the gaseous medium in a flow and directing the medium flow across the tunnel, the blower having a heater adapted to raise the temperature of the gaseous medium expelled through the nozzle above the temperature within the tunnel, the enclosure also having an exhaust port between the air barrier closures and an exhaust blower for removing a portion of the gaseous medium from within the tunnel and reducing the pressure of the gaseous medium within the tunnel to a pressure below that of the ambient atmosphere. Also the method of heat treating process articles in such an oven in which the gaseous medium of the air barrier closure at the entrance of the oven is heated to a temperature above that of the oven. Also the method of heat treating process articles in such an oven in which the gaseous medium of the air barrier closure at the entrance of the oven is provided with moisture, and further the method of curing process articles coated with powdered paint in an oven provided with an air barrier closure at the entrance to the oven in which the gasses in the closure are heated to a temperature above that of the oven and provided with moisture.

23 Claims, 4 Drawing Sheets

METHOD OF HEAT TREATING ARTICLES AND OVEN THEREFOR

This invention relates to methods for heat treating articles, particularly to heat curing of paint applied to articles in a powdered state. This invention also relates to industrial ovens provided with at least one opening for receiving articles for processing and an improved air barrier for closing the opening.

BACKGROUND OF THE INVENTION

Widely used industrial painting processes mount the articles to be painted on hangers carried on a conveyor and apply a coating of liquid paint onto the cleaned and prepared surfaces of the articles, generally by spraying or immersing the articles in a body of liquid paint. Thereafter the articles are transported by the conveyor through an entrance opening into an oven operated at an internal temperature sufficient to cure the paint on the articles, generally of the order of 350 to 400 degrees Fahrenheit. Each article is maintained within the oven for a sufficient period of time to complete the curing process. The painted articles are then removed from the oven, generally through an exit opening.

Within the oven, the atmosphere is contaminated by vapor liberated from the paint in the curing process, and it is desirable to provide air barriers at the entrance and exit openings of the oven in order to reduce the heat and contamination escaping from the oven into the surrounding atmosphere, and to reduce the energy consumed by the oven. A highly effective air barrier for such industrial ovens is described in U.S. Pat. No. 4,298,341 of the present inventor entitled INDUSTRIAL OVEN HAVING AIR RECIRCULATING MEANS FOR MINIMIZING HEAT LOSS.

The vapor produced by curing of liquid paint constitutes an environment hazard. Within the oven, paint vapor must be restricted to a relatively low level to reduce the risk that the volatile vapor will ignite, and this is accomplished by providing an exhaust from the oven and a fresh air flow into the oven. The exhaust of solvent vapor from the liquid paint curing process is a cost of operation, since it entails loss of heat and disposal of the exhausted vapor, generally to the ambient atmosphere.

The use of powdered paint, rather than liquid paint, to paint manufactured articles reduces the amount of solvent required and also paint required to paint an article. Paint overspray, which is the portion of the paint spray which fails to become attached to an articles in the spraying process, is greatly reduced by the use of powdered paint. Further, the quantity of solvent present in powdered paint is significantly less than that in a comparable body of liquid paint, thus reducing the vapor liberated in curing each processed article.

The painting processes which industry had developed using powdered paint applies a layer of paint in powdered state onto the articles to be painted, and then in the usual manufacturing process, transports the articles on a conveyor line to and through an industrial oven provided with entrance and exit openings with air barrier closures. The conveyor line transports the powder laden articles directly across the air flow of the entrance air barrier. To be efficient, the air barrier requires a relatively high flow rate, and suitable air flow rates for the air barrier are often sufficient to move paint powder about on the surface of the articles and to blow paint powder off of the articles passing through the entrance opening of the oven on the conveyor line, thus producing bare or thin areas of paint or paint buildup on the finished articles. Under some conditions, it has been necessary to reduce the air flow in the entrance air barrier of the oven in order to ameliorate this condition, thus reducing the effectiveness of the air barrier.

The industrial ovens known to the art require a large space, are costly to construct, and have relatively high operating costs, particularly in high production applications. If the oven must heat treat items being produced at a high rate, the oven must be long enough to provide the required residence time for articles moving within the oven at the production rate. Heat is transferred from the environment within the oven, which is an air and vapor mixture, to the process articles largely by contact of the oven environment with the articles. Since the gaseous oven environment of conventional ovens is largely dry air, the oven environment has a low thermal capacity. Heat transfer from the oven environment to the articles in process largely occurs through a film of air on the surface of the article, the film being periodically replaced by circulation of the environment within the oven. This process results in a relatively low rate of heat transfer from the environment of the oven to the precess articles, thus requiring a long path within the oven to provide the desired heat treatment to the articles.

Further, the use of air barriers for closures at the entrance and exit openings of an oven results in a gradual temperature increase from the opening to the interior of oven, thus providing regions within the oven adjacent to the entrance and exit opening of reduced heat transfer. Accordingly, industrial ovens for high production applications are long, resulting in relatively high heat loss and relatively high equipment and building costs.

SUMMARY OF THE INVENTION

In general, the inventor seeks to provide an improved industrial oven which overcomes the deficiencies of such ovens of the prior art. The inventor also seeks to provide an improved air barrier for an industrial oven which overcomes the deficiencies of air barriers of the prior art.

More specifically, it is an object of the present invention to provide an industrial oven which achieves a great rate of heat transfer from the gaseous environment within the oven to the articles in process. It is also an object of the present invention to provide an improves method of operating an industrial oven which achieves a greater rate of heat transfer from the environment within the oven to the articles in process.

It is a further object of the invention to provide an industrial oven with an entrance opening provided with an air barrier which has a reduced tendency for moving powdered paint on process articles from that of the prior art. It is also an object of the present invention to provide a method of operating an air barrier which reduces the tendency of the flow of gases in the air barrier to move powdered paint on process articles and which provides significantly greater heat transfer to the process articles than the methods of the prior art.

An industrial oven is conventionally provided with an entrance opening covered by an air barrier closure. The air barrier closure relies upon a flow of air or other gases across the opening to restrict flow of the gaseous oven environment through the opening into the ambient atmosphere exterior of the oven. In the air barrier disclosed in the present inventor's U.S. Pat. No. 4,298,341, the air flow for the air barrier closure is obtained from the interior of the oven and hence is at the temperature of the environment of the oven. In accordance with the present invention, the flow of air or other gases in the air barrier is heated to a temperature above that of the temperature of the gaseous environment of the oven to reduce the density of the air barrier flow, thereby reducing the tendency of the air barrier flow to disturb articles and the powdered paint on such articles as they enter the oven through the entrance air barrier closure, and accelerating heating of the articles. In a preferred construction of an air barrier closure, the flow for the air barrier is taken from the environment in the interior of the oven and heated prior to use in the entrance air barrier.

To cure powdered paint, a process article is raised to a temperature of the order of 350 to 400 degrees Fahrenheit. Hence, the environment in the interior of the oven must be around 350 to 400 degrees Fahrenheit. In the preferred construction of an air barrier closure, gases are withdrawn from the environment of the oven, heated to a temperature above that of the environment of the oven, namely, a temperature of at least 400 degrees and preferably 450 to 600 degrees Fahrenheit, and then employed in the gaseous flow across the opening covered by the air barrier closure.

Heating of the gaseous flow in the entrance air barrier closure to a temperature above that of the environment of the oven produces two beneficial effects. First, heating the environmental gases for use in the flow of the air barrier reduces the density of those gases, thus reducing the force applied to the powder on powder laden process articles and reducing the tendency for the powder to be blown from its proper location on the articles. Second, the air in the flow of the entrance air barrier is hot enough to initiate the liquefaction process that the powdered paint experiences during the painting process, thus making the powder less likely to be displaced from its proper location on the articles and accelerating the paint curing process.

The inventor has found that the presence of moisture on the powder laden process articles will further reduce the tendency of the flow of the entrance air barrier to disturb the powdered paint. The presence of moisture in association with the paint powder on the process articles increases the weight of the powder and its resistance to movement, and also wets the surfaces of the articles. The moisture can be associated with the powder on the powder laden article either prior to entry of the process article into the flow of the air barrier closure, or after the process article is disposed within the flow.

Except for low levels of moisture, the inventor prefers to associate the moisture with the powdered paint in the flow of the entrance air barrier of the oven in order to avoid any tendency of the article to oxidize. In the preferred construction, moisture in the form of vapor is introduced into the flow of environmental gases from the oven and heated to the temperature of the flow of the air barrier, thus converting the moisture to super heated steam. Each process article enters the flow of the entrance air barrier at approximately ambient temperature, and contact of the flow of the air barrier and the process article results in the formation of a film of gases of the flow on the surfaces of the process article. This film on the process article loses heat to the process article, and at the beginning of this process the film drops in temperature to below the boiling point, thereby forming water vapor or water droplets which become deposited on the powder laden process article and, transfers the heat of condensation to the process article.

The gas molecules of the film on the process article are continuously being changed and replaced by the flow of the gases within the air barrier and the circulation of gases within the oven as the process article moves through the oven, and at the same time, more moisture and more heat are being transferred to the process article. As the process article gains heat, the temperature of the article increases, and in time the temperature of the process article will exceed the boiling point of water. When the temperature of the process article exceeds the boiling point, the water vapor and any water droplets present on the powder laden process article will vaporize, thus removing the moisture from the process article.

The thermal capacity of super heated steam greatly exceeds that of air at the same temperature, and accordingly the presence of super heated steam in the environment of the oven results in the transfer of significantly greater quantities of heat to the process article and a significantly higher heat transfer rate as the article passes through the oven. The greater heat transfer provided by the super heated steam reduces the required residence time for heat treating the process article and permits use of a shorter oven for the same production rate. The shorter oven is less costly to construct and house, and the shorter oven also has lover heat losses than the longer oven, which in turn reduces the operating expenses of the oven.

Further objects and advantages of the present invention will be apparent from the following description, particularly with reference to the following drawings.

Figure 1:
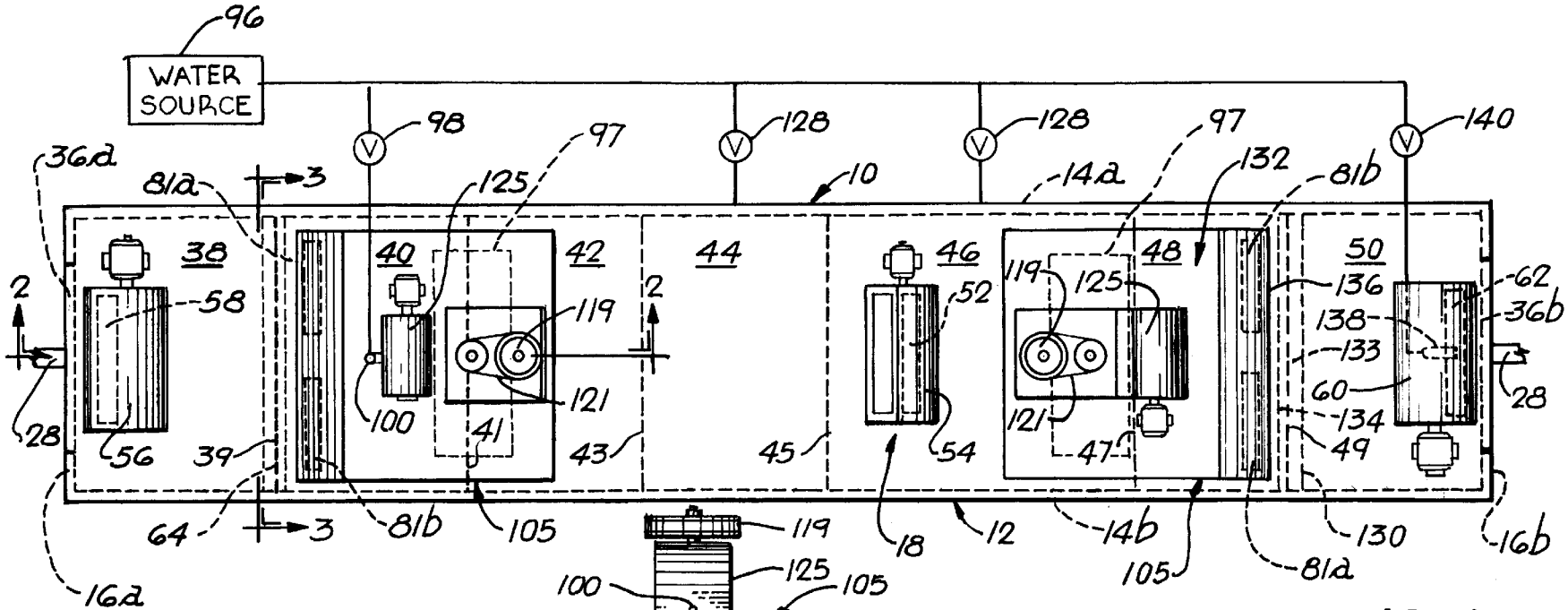
FIG. 1 is a plan view of an industrial oven constructed according to the present invention.
Figure 3:
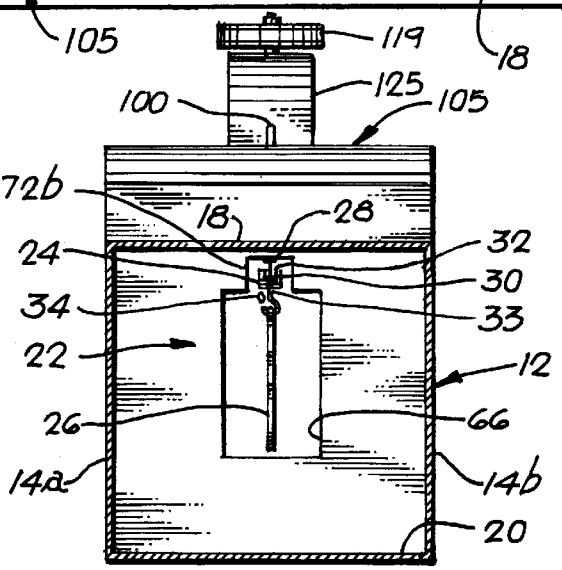
FIG. 3 is a sectional view of the oven taken along the line 3—3 of FIG. 2.
Figure 2:
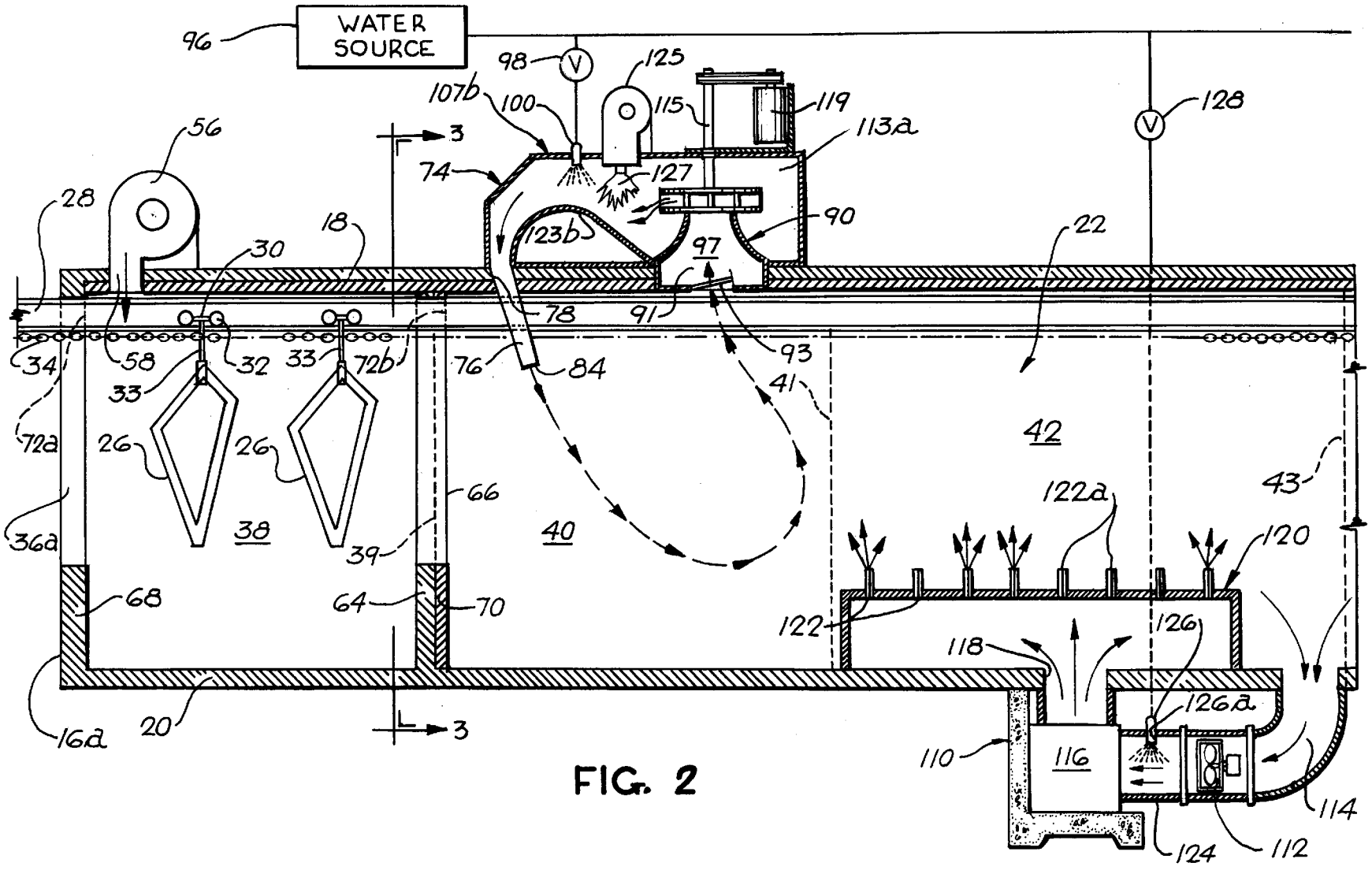
FIG. 2 is a fragmentary sectional view taken along the line 2—2 of FIG. 1, the view illustrating the entrance opening of the oven and the air barrier closure for said opening.
Figure 5:
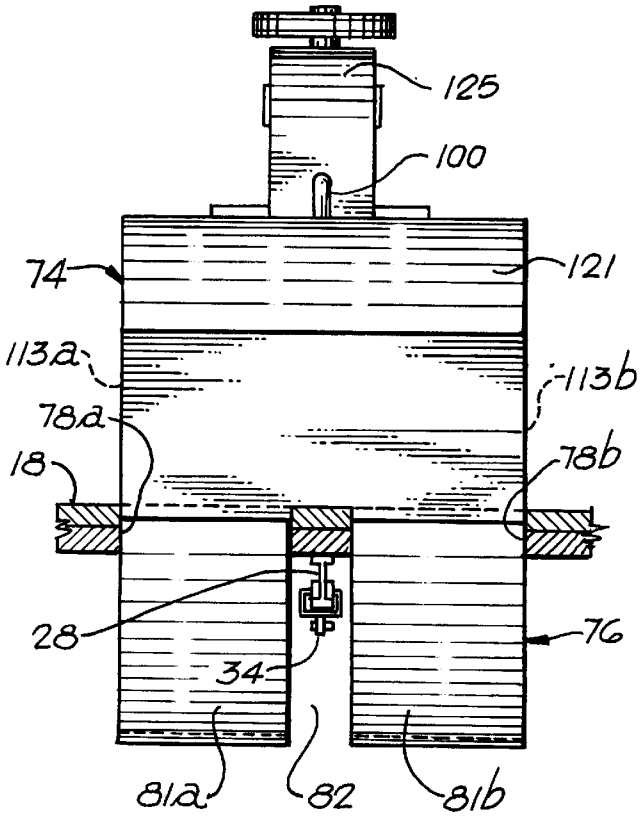
Figure 4:
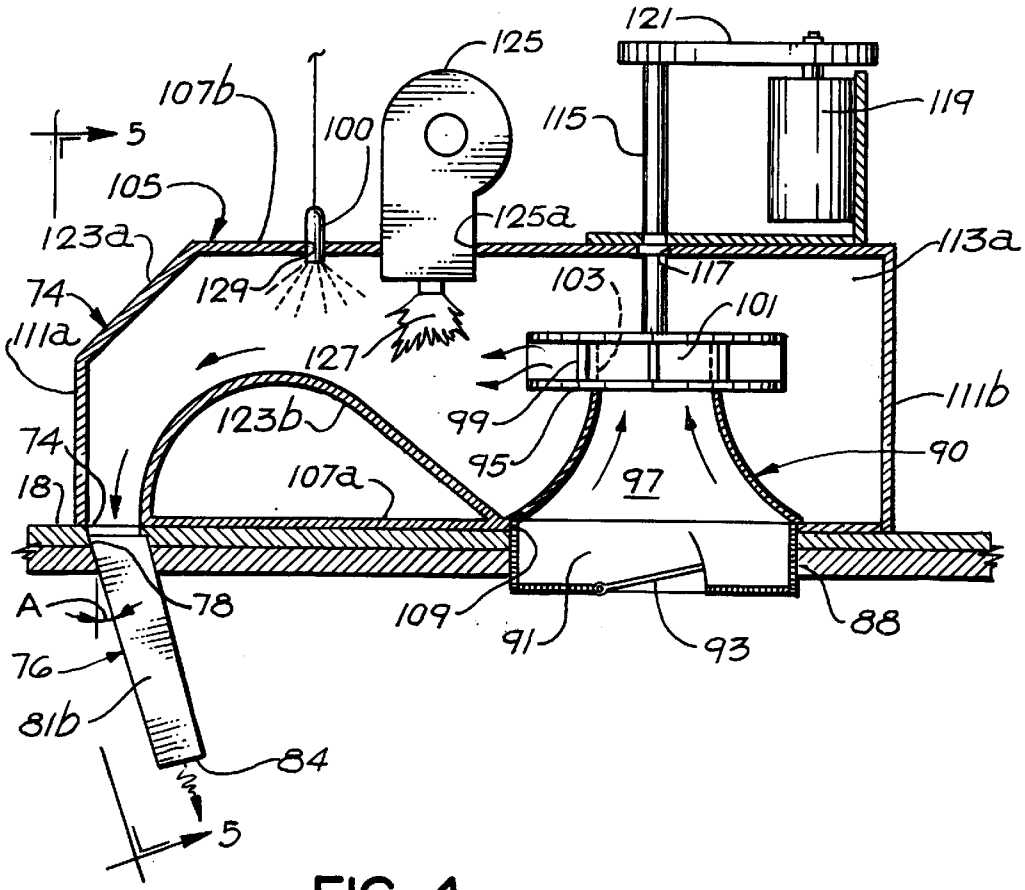

The FIG. 4 is a fragmentary sectional view of the industrial oven of FIGS. 1 through 3 illustrating in greater detail the construction of the air barrier closure illustrated generally in FIGS. 1 through 3;

FIG. 5 is a sectional view taken along line 5—5 of FIG. 4; and

Figure 6:
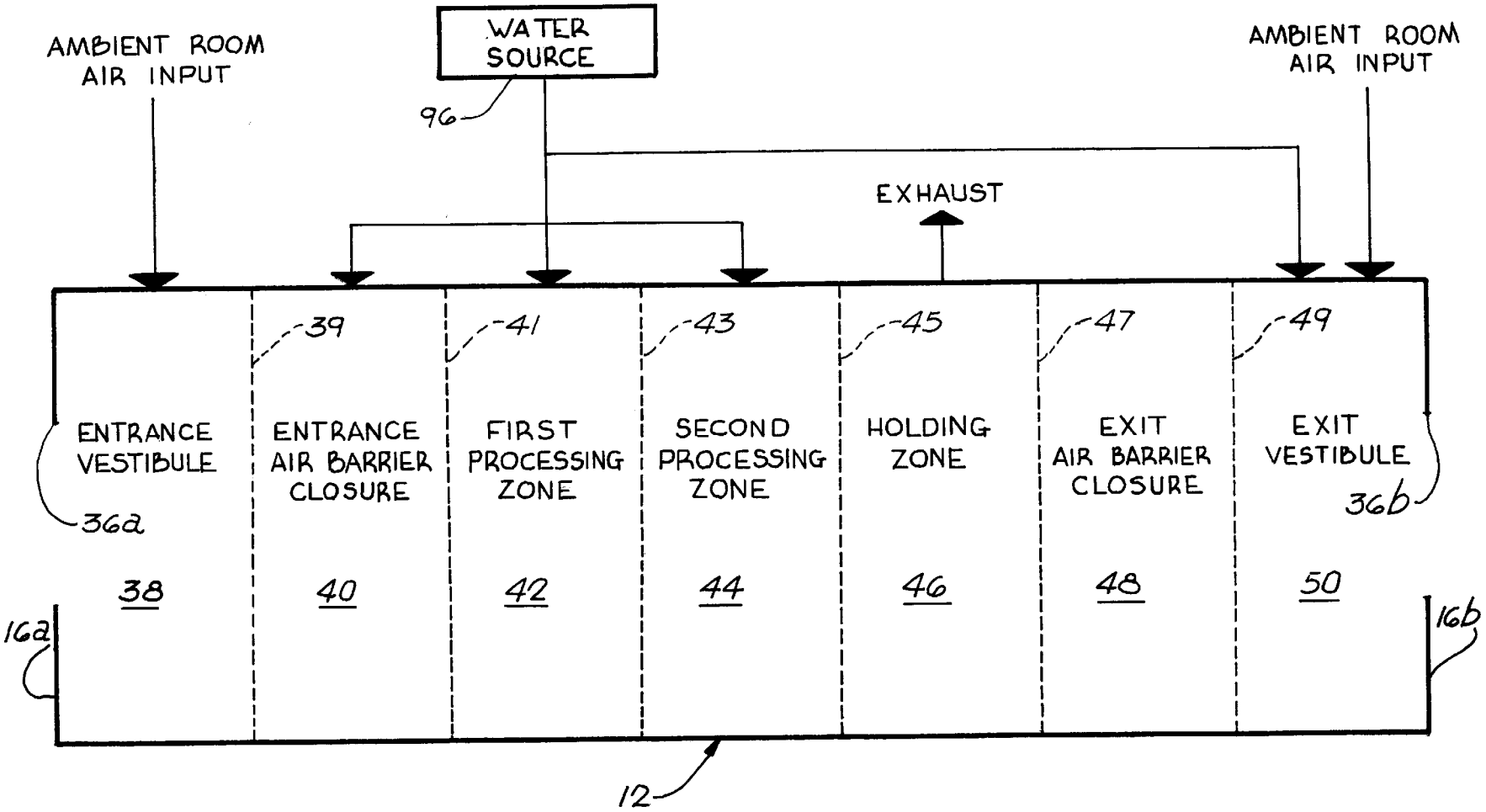

FIG. 6 is a diagrammatic flow chart for the oven of FIGS. 1 through 5.

DETAILED DESCRIPTION OF THE INVENTION

FIGS. 1 through 5 illustrate an industrial oven 10 which has an enclosure 12 formed by a pair of elongated side walls 14*a* and 14*b*, a pair of end walls 16*a* and 16*b*, a top wall 18 and a bottom wall 20. The walls of the enclosure 12 form an elongated linear tunnel or chamber 22 with a rectangular cross section for receiving and heat treating articles 26.

The oven 10 is provided with a conveyor 24 to carry a continuous series of article 26 into and through the elongated chamber 22. The conveyor 24 has and elongated rail 28 which extends through the chamber 22 and is mounted centrally on the underside of the top wall 18 of the enclosure 12. The rail 28 is disposed perpendicular to the end walls 16*a* and 16*b*, and supports a series of carriages 30 spaced apart along the rail. Each carriage 30 is mounted on the rail 28 on rollers 32 which are adapted to roll along the rail. Each carriage 30 includes a depending hanger 33 for removably mounting one of the article 26 to be processed in the chamber 22.

The conveyer 24 is also provided with a continuous chain 34 which is disposed beneath the rail 28 and is attached to each of the carriages 30. The chain 34 is driven by a motor, not shown, and advances the carriages 30 along the elongated rail 28 at a fixed speed to transport the process article through the elongated chamber 22.

The end wall 16*a* of the enclosure 12 is provided with an entrance opening 36*a* and the end wall 16*b* is provided with an exit opening 36*b*. The conveyor 24 carries the process article through the entrance opening 36*a*, through the elongated chamber 22 and through the exit opening 36*b*. As illustrated in FIG. 1 and 6 the elongated chamber 22 is divided into seven different sections designated 38, 40, 42, 44, 46, 48 and 50, each section having different operating conditions. It is to be understood that the chamber 22 of the oven 10 could be divided into more or less sections depending upon the operating conditions desired in each of the sections.

As best illustrated in FIG. 2, section 38, which is referred to as the entrance vestibule, includes end wall 16*a* and the entrance opening 36*a*. The entrance vestibule 38 has a common interface 39 with section 40, which is referred to as the entrance air barrier closure, and the entrance air barrier closure 40 has a common interface 41 with section 42 designated the first processing zone. In like manner, the first processing zone 42 has a common interface 43 with the second processing zone 44, and processing zone 44 has a common interface 45 with holding zone 46. Also, holding zone 46 has a common interface 47 with an exit air barrier closure 48, and the exit air barrier enclosure 48 has a common interface 49 with section 50, which is designated the exit vestibule.

Industrial ovens for curing paint are required by government regulations to have a positive exhaust from the interior of the oven to prevent buildup of flammable vapor within the oven. As illustrated in FIG. 1, the oven 10 provides an exhaust port 52 in the top wall 18 of the enclosure 12, and the port extends into the holding zone 46. An exhaust fan 54 is mounted on exterior surface of the top wall 18, and the fan 54 is connected to the opening 52 and assures removal of the required portion of the gaseous environment from the chamber 22 of the oven 10, thus providing a gas pressure within the oven which is less than the external ambient gas pressure. The exhausted gases from the fan 54 are discharged through a chimney, not shown, to the atmosphere.

The exhaust gases from, the oven 10 are replaced by ambient air which enters the chamber 22 through four paths. A first flow of air from the ambient atmosphere is introduced through a fan 56 and port 58 into the entrance vestibule 38, and a second flow of ambient atmosphere is introduced into the exit vestibule 50 through a fan 60 and port 62. The third and fourth paths for makeup air utilize leakage through the entrance opening 36*a*and exit opening 36*b*. About one third of the makeup air enters the chamber 22 through the entrance opening 36*a* and exit opening 36*b*, and one third of the makeup air enters through each of the fans 56 and 60 into the entrance vestibule 38 and exit vestibule 50, respectively. All makeup air enters the chamber 22 through leakage of the air barriers closures 40 and 48.

The entrance vestibule 38 extends between the end wall 16*a* and a first interior wall 64 which is disposed vertically on the interface 39 between the entrance vestibule 38 and the entrance air barrier closure 40. The first interior wall 64 is parallel to the end wall 16*a* and perpendicular to the longitudinal axis of the enclosure 12. The first interior wall 64 has an opening 66 which confronts the opening 36*a* in the end wall 16*a* and is the same size and shape as the opening 36*a*. The opening 36*a* in the end wall 16*a* does not extend to the bottom wall 20 of the enclosure 12, thus providing a base portion 68 between the bottom wall 20 and the opening 36*a* which functions as a weir to retard any flow of air through the opening 36*a* from the entrance vestibule 38. In like manner, the opening 66 in the first interior wall 64 does not extend to the bottom wall 20 of the enclosure 12, thus providing a base portion 70 between the bottom wall 20 and the opening 66 which functions as a weir to retard any flow of air through the opening 66 from the entrance air barrier closure 40.

The opening 36*a* and 66 are made as small as possible but sufficiently large to permit ingress of the process article on the conveyor 24. Both openings 36*a* and 66 are rectangular except for slots 72*a* and 72*b* located centrally of the upper sides of the opening 36*a* and 66, respectively, and the conveyor rail 28 extends through slots 72*a* and 72*b*. The longitudinal axes of the openings 36*a* and 66 extend from the base portion 68 or 70 to the upper side of the openings 36*a* and 66, as illustrated in FIG. 3. The inventor has found that the distance between the end wall 16*a* and the first interior wall 64 must be at least one-half and preferably three-quarters of the height of the opening 66 in the first interior wall 64 to be effective in reducing leakage of gases from the interior of the chamber 22 of the oven 10 to the surrounding atmosphere.

In addition to being a conduit for the makeup air for the oven 10, the entrance vestibule 38 and exit vestibule 50 are for the purpose of reducing leakage of the interior gases of the oven into the surrounding atmosphere, and to provide a safety zone to protect personnel from the high temperature conditions within the entrance air barrier closure 40 and exit air barrier closure 48 of the oven. The makeup air entering the entrance vestibule 38 is at the ambient temperature surrounding the oven, and hence significantly lower in temperature than any leakage gases from the air barrier zone 40 of the oven. The makeup air will mix with any such leakage gases, thus lowering the temperature of the leakage gases, and causing the mixture of leakage gases and makeup air to fall and flow together through the opening 66 into the interior of the oven, thus reducing the gasses that escape from the interior chamber of the oven.

The entrance air barrier closure 40 will be effective to reduce the leakage of the interior gases from the interior of the chamber 22 if the base portion 70 of the first interior wall 64 is omitted and the opening 66 extends to the bottom wall 20 of the enclosure 12, but not as effective as a construction in which the base portion 70 extends upwardly a substantial distance, preferably about two feet. Also, the entrance vestibule 38 will be effective to reduce the leakage of the interior gases from the interior of the chamber 22 if the base portion 68 of the end wall 16*a* is omitted and the opening 66 extends to the bottom wall 20 of the enclosure 12, but not as effective as a construction in which the base portion 68 extends upwardly a substantial distance, preferably about two feet. The vestibule is also effective in reducing the leakage of the gases from the interior of the chamber 22 to the ambient atmosphere even if the end wall 16*a*, or the first interior wall 64, or both walls 16*a* and 64, are omitted from the oven construction.

The entrance air barrier closure 40 contains an air barrier 74 for substantially sealing the opening 66 in the first interior wall 64 against the flow of gases from zones 42, 44 and 46 of the chamber 22. The air barrier 74 has a nozzle 76 which extends through, and is sealed within, the edges of an elongated slot 78 in the top wall 18 of the enclosure 12 parallel to and adjacent to the inner side of the first interior wall 64 to communicate with the chamber 22. The nozzle 76 has depending end portions 81*a* and 81*b* which are spaced from each other to form a slot 82 which accommodates the rail 28. Each of the end portions has an elongated aperture 84 confronting and communicating with the interior of the chamber 22.

The depending end portions 81*a* and 81*b* are disposed on a common plane, and the plane 86 is disposed at an included angle, designated A, of about 15 to about 45 degrees to the plane of the interior wall 64. A supply of gases for the nozzle 76 from the environment of the chamber 22 is provided by a port 88 which extends through the top wall 18. The port 88 is disposed in the top wall 18 spaced from the nozzle 76 toward the interface 41 between the entrance air barrier closure 40 and the first processing zone 42. The port 88 accommodates a plug blower 90 mounted on the top wall 18. The blower 90 has a circular damper assembly 91 which confronts the chamber 22 of the enclosure 12, and the damper assembly 91 has a pivotally adjustable damper plate 93 for controlling the flow of gaseous medium from the chamber 22. The blower 90 also has a distributor ring 95 mounted in a fixed position by a generally truncated conical guide 97 which is mounted between the distributor ring 95 and the damper assembly 91. The distributor ring 95 is provided with radially disposed veins 99 forming passages 101 for the flow of gases, and a squirrel cage rotor 103 is rotatably and coaxially mounted within the distributor ring 95.

The blower 90 is coupled to the inlet end 94 of the nozzle 76 by a generally rectangular air-tight heater box 105 mounted on the top wall 18 of the enclosure 12 about the plug blower 90. The heater box 105 has a bottom wall 107*a* mounted on the top wall 18 of the enclosure 12, and the bottom wall is provided with an opening 109 which accommodates the damper assembly 91. The heater box 105 has a top wall 107*b* spaced from and parallel to the bottom wall 107*a*. A front wall 111*a*, back wall 111*b*, and a pair of opposing side walls 113*a* and 113*b* complete the heater box 105.

The squirrel cage rotor 103 has a shaft 115 which extends vertically from the blower unit 90 through an aperture 117 in the top wall 107*b* of the heater box 105, and the shaft 115 is coupled to a motor 119 by a belt and pulley assembly 121 mounted on the shaft 115. The motor 119 rotates the rotor 103 within the distributor ring 95, thus expelling the gases flowing into the blower 90 through the damper assembly 91, through the passages 101 of the distributor ring 95, and into the interior of the heater box 105. The heater box 105 acts as a duct for directing the flow of gases from the blower 90 to the slots 78*a* and 78*b*, and hence to the depending portion 81*a* and 81*b* of nozzle 76. To facilitate the flow, the heater box 105 has a flat strip 123*a* extending between the top wall 107*b* and the front wall 111*a*, and a curved deflector 123*b* confronting the bottom wall 107*a* between the slots 78*a*, 78*b* and the opening 109 for the blower unit 90.

A direct fire burner 125 is mounted in an opening 125*a* located centrally in the top wall 107*b* of the heater box 105 between the blower 90 and the front wall 111*a*, and the burner 125 produces a flame illustrated at 127 within the heater box 105 for the purpose of heating the gasses flowing through the nozzle 76 to a temperature above that of the chamber 22 of the oven. The burner 125 is preferably operated on gas or oil from a source not shown, and the burner 125 is provided with a flow of air to support the burner combustion from the surrounding ambient atmosphere. The exhaust of the burner 125 becomes a part of the environment within the chamber 22 of the oven.

A spray nozzle 100 is mounted in an aperture 129 in a central portion of the top wall 107*b* of the heater box 105 between the burner 125 and the front wall 111*a* of the heater box 105, and the spray nozzle 100 is connected to the source of water 96 to introduce the necessary moisture into the air barrier closure 74.

The stream of air and gases from the nozzle 76 should have a relatively low velocity in order to avoid unduly disturbing the articles 26 carried by the hanger 33 and to minimize the likelihood of moving powdered paint particles disposed on the articles. The inventor has achieve good results with a velocity of about 900 feet per minute for each foot of height of the opening 66 in the first internal wall 64.

In the usual installation, the operating temperature of the chamber 22 is about 350 to 400 degrees Fahrenheit, and the inventor has found that the temperature of the mixture of air and gases from the nozzle should be preferably between 450 and 600 degrees Fahrenheit. The increased temperature reduces the density of the air and gases and reduces the tendency of the flow from the nozzle 76 disturbing the paint powder on the process articles 26. The operating temperature of the chamber 22 of the oven is dictated by the requirements of the material being heat treated, and the above temperatures are effective for curing paint, whether it is applied as liquid or powder. There are some materials which are heat treated at lower temperatures, such as in a chamber 22 heated to 200 degrees Fahrenheit, and the present invention may be advantageously practiced in heat treating such products, the temperature of the air and gasses passing through the nozzle 76 being at least 250 degrees Fahrenheit to 600 degrees Fahrenheit.

As stated above, the inventor has found that it is desirable to introduce water vapor into the flow of air and gases from the nozzle 76. For this purpose, the pressurized source of water 96, which may be a municipal water supply, is coupled to the heater box 105 through a valve 98 and the spray nozzle 100. When the valve 98 is opened, water flows through the valve and the spray nozzle 100 and enters the chamber of the heater box 105 as a mist. Since the temperature of the heater box 105 is well above the boiling point of water, the water evaporates to form steam at the temperature of the interior of the heater box. This super heated steam is then forced into the chamber 22 through the nozzle 76.

As illustrated in FIGS. 1 and 5, the oven 10 has a first processing zone 42 and a second processing zone 44 for heat treating the process articles 26. An oven constructed in accordance with the present invention may have only a single processing zone, or more than the two processing zones illustrated, and the processing zones may have identical constructions or be different, depending upon the requirements for the particular oven. In the particular embodiment of the invention described, these processing zones 42 and 44 are identical in construction, and only the first processing zone 42 will be illustrated in detail. The first processing zone 42 is operated differently from the second processing zone 44 as will be described hereinafter.

The first processing zone 42 extends between the interface 41 with the air barrier closure 40 and the interface 43 with the second processing zone 44. The processing zone 42 contains a heating system 110 which is provided with a blower 112 which draws air and gas vapor from the chamber 22 through a return duct 114 in the bottom wall 20 of the enclosure 12. The blower 112 then forces the air and vapor through a furnace or heat exchanger 116, and the heated air and vapor is then returned to the chamber 22 through a port 118 in the bottom wall 20 of the enclosure 12 and an elongated distribution manifold 120 disposed within the enclosure 12 on the bottom wall 20 parallel to the axis of elongation of the enclosure 12. The manifold 120 has a plurality of spaced apertures 122 disposed along the axis of elongation of the manifold 120, and a short hollow stub 122*a* is mounted in each aperture and extends from the manifold to distribute the heated air and gases within the chamber 22.

A coupler 124 is connected between the blower 112 and the heater 116, and a spray nozzle 126 is mounted in an aperture 126*a* in the coupler. The spray nozzle 126 is connected to the source of water 96 through a valve 128, and the spray nozzle delivers a spray of water into the air and vapor mixture entering the heater 116 to produce super heated steam within the chamber 22 of the first processing zone 42.

The second processing zone 44 extends from the interface 43 with the first processing zone 42 to the interface 45 with the holding zone 46, and the second processing zone is constructed in the same manner as the first processing zone 42, but not operated in the same manner as the first processing zone. The oven 10 is designed to bring the process article up to the desired temperature for heat treating in the processing zones, and if the total heat required to increase the temperature of the process articles 26 to the processing temperature can be transferred from the environment of the chamber 22 in the single processing zone 42, no additional processing zones are required. However, if the amount of heat which must be acquired by a process article to raise its temperature to the desired heat treating temperature exceeds the maximum quantity of heat that the first processing zone can produce and transfer to the process article during the period the process article resides in that zone, more than a single processing zone must be utilized.

The holding zone 46 extends from the interface 45 with the second processing zone 44 to the interface 47 with the exit air barrier closure 48. The holding zone 46 is constructed in the same manner as the first processing zone 42 with two important exceptions, and the identical portions of the holding zone 46 will not be further described or illustrated. The first exception is that the holding zone is designed to provide the desired residence time at the desired processing temperature for the process articles, and accordingly, the length of the channel 22 within the holding zone 46 is much longer than the length of the channel 22 within the first processing zone 42. The second exception is that the exhaust port 52 is located in the top wall 18 of the enclosure 12 centrally between the interfaces 45 and 49 and centrally between the side walls 14*a* and 14*b*.

The exit air barrier closure 48 extends between the interface 47 with the holding zone 46 and the interface 49 with the exit vestibule 50, and the air barrier closure 48 is identical in construction to the entrance air barrier closure 40 with two exceptions. The first exception is that the connection between the water source 96 and the heater box 105, comprising the valve 98 and nozzle 100 of the entrance air barrier closure, is omitted from the exit air barrier closure 48. The second exception is that construction of the exit air barrier closure 48 is reversed in direction to seal against the air and gases of the channel 22 escaping from the channel 22 through the exit vestibule 50 and the exit opening 36*b*.

More specifically, the exit air barrier closure 48 has a second internal wall 130 disposed on the interface 49 between the exit air barrier closure and the exit vestibule 50, the second internal wall being identical to the first internal wall 64. The exit air barrier closure 48 contains an air barrier 132 for substantially sealing the opening 133 in the second internal wall 130 against the flow of gases from zones 42, 44 and 46 of the chamber 22. The air barrier 132 has a nozzle 134 which extends through and is sealed within the edges of an elongated slot 136 in the top wall 18 of the enclosure 12 parallel to and adjacent to the inner side of the second internal wall 130 to communicate with the chamber 22. The nozzle 134, and other portions of the exit air barrier closure 48, are identical to the nozzle 76, and other portions of the entrance air barrier closure 40, and will not be further described.

The exit vestibule 50 is substantially identical to the entrance vestibule with two exceptions. The first exception is that the exit vestibule 50 is located between the interface 49 with the exit air barrier closure 48 and the end wall 16*b*, and the port 62 for introducing makeup air into the exit vestibule 50 is disposed adjacent to the end wall 16*b*. The second exception is that a spray nozzle 138 is mounted on the fan 60 confronting the port 62 and connected to the water source 96 through a valve 140 to spray a limited quantity of water into the makeup air being injected into the exit vestibule.

In one particular construction of an oven as set forth above, the oven was designed to process metal articles weighing 100 pounds each disposed at intervals of 7.5 feet on the conveyor 24 at a rate of 176 articles per hour. The articles are coated with powdered paint and are to be cured at a temperature of 400 degrees Fahrenheit for a period of 15 minutes. The conveyor speed is 22 feet per minute.

The entrance opening 36*a*, the exit opening 36*b*, the opening 66 in the first interior wall and the opening in the second interior wall 130 have heights of 8.0 feet and widths of 6.0 feet, and the openings are disposed upwardly of base portions 68 of 2.0 feet. The entrance and exit vestibules 38 and 50 are 8.0 feet in length. The entrance air barrier closure 40 and the exit air barrier closure 48 have lengths of 24.0 feet and 12.0 feet, respectively. The first processing zone 42 and the second processing zone 44 are each 44.0 feet long, and the holding zone 46 is 330.0 feet in length. All measurements referred to above are taken along the axis of elongation of the channel 22.

In this construction, the exhaust fan 54 pumps about 7789 cubic feet of air per minute at a temperature of about 400 degrees Fahrenheit from the holding zone 46, thus assuring that volatile gas vapor will be maintained at a safe level within the oven chamber 22. About 2400 cubic feet of air per minute at room temperature of about 70 degrees Fahrenheit is pumped into the entrance vestibule 38 through the fan 56, and about 2400 cubic feet per minute of air at about 70 degrees Fahrenheit is pumped into the exit vestibule 50 through the fan 60. Since the combined makeup air volume is 4800 cubic feet per minute, far less than the exhaust from the holding zone 46, a lower pressure will result in the air barrier closures 40 and 48, processing zones 42 and 44, and holding zone 46, thus resulting in an inflow of the ambient air surrounding the enclosure 12 through the openings 36*a* and 36*b*. As a result it is less likely that the environment of the air barrier closures 40 and 48, processing zones 42 and 44, and holding zone 46, will escape into the surrounding atmosphere exterior of the enclosure 12.

In operation, 100 pound metal articles with surfaces covered with paint powder enter the entrance opening 36*a* at a temperature of about 70 degrees Fahrenheit and enter the air barrier closure 40 at about the same temperature. The entrance air barrier closure 40 is subjected to a flow of 10,757 cubic feet of air and vapor from the nozzle 76 at a temperature of 550 degrees Fahrenheit and 4.4 gallons of water per minute is in the flow in the form of super heated steam, thus heating the article to about 95 degrees when it leaves the entrance air barrier closure 40. Processing zones 42 and 44 are maintained at 400 degrees Fahrenheit, and the article temperature rises to about 212 degrees Fahrenheit in the first processing zone 42 and to a temperature of about 400 degrees Fahrenheit in the second processing zone 44. Each of these processing zones 42 and 44 also receives 4.4 gallons of water per minute injected into the heating systems thereof. The holding zone 46 is also maintained at a temperature of about 400 degrees Fahrenheit by its heater, and no water is injected into the holding zone. About 7789 cubic feet of exhaust gases per minute are removed from the holding zone and conveyed to the ambient atmosphere.

The exit air barrier closure 48 receives the articles from the holding zone at about 400 degrees Fahrenheit. The nozzle of the exit air barrier closure receives about 5378 cubic feet of air and vapor per minute at a temperature of about 400 degrees Fahrenheit to maintain the temperature within the holding zone at its desired value to the interface with the exit air barrier closure. The exit vestibule 50 receives the articles at about 400 degrees Fahrenheit and cools the articles to about 336 degrees Fahrenheit at the exit opening 36*b*. The exit vestibule 50 is provided with about 2400 cubic feet per minute of air at about 70 degrees Fahrenheit and 2.8 gallons per minute of water vapor through the exit vestibule fan. The temperature of the exit vestibule is about 175 degrees Fahrenheit.

Those skilled in the art will perceive of many applications of the present invention in addition to those specifically set forth, and also many structures in addition to those disclosed for practicing the present invention. It is therefor intended that the present invention be not limited by the foregoing specification, but only by the following claims.

The invention claimed is:

1. An industrial oven for heat treating a series of articles comprising an enclosure having a tunnel disposed therein with an axis of elongation, said enclosure having a first opening adapted to receive articles for processing and communicating with the tunnel, said enclosure having an exhaust port spaced from the first opening and communicating with the tunnel, means operatively associated with the enclosure to heat the tunnel to a heat treating temperature of at least 200 degrees Fahrenheit, a first air barrier closure disposed within the tunnel confronting the first opening and disposed between the first opening and the means to heat the tunnel and the exhaust port, said first air barrier closure having a first blower with a first inlet for receiving a gaseous medium and a first nozzle for expelling the gaseous medium from the first blower in a flow and directing the medium flow across the tunnel, said first blower having a first heater disposed between the first inlet and the first nozzle, the first heater being adapted to raise the temperature of the gaseous medium expelled through the first nozzle above the temperature within the tunnel, and an exhaust blower communicating with the exhaust port for removing a portion of the gaseous medium from within the tunnel and reducing the pressure of the gaseous medium within the tunnel to a pressure below that of the ambient atmosphere exterior of the enclosure.

2. An industrial oven for heat treating a series of articles comprising claim 1 in combination with a source of water, and means for injecting a first flow of water into the first blower of the first air barrier closure between the first inlet and the first nozzle.

3. An industrial oven for heat treating a series of articles comprising claim 2 in combination with means for injecting a second flow of water into the tunnel on the side of the first air barrier closure opposite the first opening.

4. An industrial oven for heat treating a series of articles comprising claim 1 wherein the first opening is disposed in a plane substantially normal to the axis of elongation of the tunnel, and the plane of the first opening is spaced from the nozzle of the first air barrier closure to form a first vestibule.

5. An industrial oven for heat treating a series of articles comprising claim 4 wherein the first opening has a vertical and a horizontal axis which define the plane of the first opening, and the plane of the first opening is spaced from the nozzle of the first air barrier closure by a distance at least equal to one-half of the vertical axis of the first opening.

6. An industrial oven for heat treating a series of articles comprising claim 4 wherein the portion of the enclosure defining the first vestibule is provided with a first port disposed in an upper portion thereof and extending into the tunnel from the exterior of the enclosure, and a blower sealed within the first port has an inlet communicating with the ambient atmosphere for providing a flow of gases from the ambient atmosphere into the first vestibule.

7. An industrial oven for heat treating a series of articles comprising claim 4 wherein a first interior wall is disposed within the tunnel between the first opening and the first nozzle of the first air barrier closure, the first interior wall having a second opening confronting the first opening and being adapted to pass articles to be processed.

8. An industrial oven for heat treating a series of articles comprising claim 7 wherein the enclosure has a pair of side walls substantially vertically disposed on opposite sides of the axis of elongation, a top wall disposed above the axis of elongation, and a bottom wall disposed below the axis of elongation, said enclosure also having a first and a second end wall disposed normal to the axis of elongation at opposite ends of the enclosure, the first opening of the enclosure being disposed in the first end wall and the second opening in the first interior wall being identical to the first opening, the first end wall having a base portion extending from the bottom wall of the enclosure to the first opening and the first interior wall having a base portion extending from the bottom wall of the enclosure to the second opening to restrict the flow of gases from within the enclosure toward and through the first opening.

9. An industrial oven for heat treating a series of articles comprising claim 8 wherein the first nozzle is mounted on the top wall adjacent to the side of the first interior wall opposite the first end wall, and the first nozzle is directed downwardly across the second opening in the first interior wall at an acute angle to the plane of the first interior wall, and the first inlet of the first air barrier closure communicates with a first port in the top wall of the enclosure adjacent to the first nozzle and on the side thereof opposite the first interior wall.

10. An industrial oven for heat treating a series of articles comprising claim 1 wherein the enclosure has a pair of side walls substantially vertically disposed on opposite sides of the axis of elongation, a top wall disposed above the axis of elongation, and a bottom wall disposed below the axis of elongation, said enclosure also having a first end wall and a second end wall disposed normal to the axis of elongation at opposite ends of the tunnel, the first opening being disposed in the first end wall and the second end wall having a third opening adapted to pass the process articles, a second air barrier closure disposed within the tunnel confronting the third opening and disposed between the third opening and the means to heat the tunnel and the exhaust port, said second air barrier closure having a second blower with a second inlet for receiving a gaseous medium and a second nozzle mounted on the enclosure for expelling the gaseous medium from the second blower in a flow and directing the gaseous medium flow across the tunnel, said second blower having a second heater disposed between the second inlet and the second nozzle, the second heater being adapted to raise the temperature of the gaseous medium expelled through the second nozzle above the temperature within the tunnel between the first and second air barrier closures, and at least one processing zone disposed within the tunnel between the first and second air barrier closures, each processing zone having a separate means for controlling the temperature of said processing zone.

11. An industrial oven for heat treating a series of articles comprising claim 10 wherein the second opening in the first interior wall is identical to the first opening in the first end wall, the first end wall having a base portion extending from the bottom wall of the enclosure to the first opening and the first interior wall having a base portion extending from the bottom wall of the enclosure to the second opening to restrict the flow of gases from within the enclosure toward and through the first opening.

12. An industrial oven for heat treating a series of articles comprising claim 10 wherein a first means for injecting a flow of water into the first air barrier closure connects the source of water between the first inlet and the first nozzle of the first air barrier closure, and a second means for injecting a flow of water into the second air barrier closure connects the source of water between the second inlet and the second nozzle of the second air barrier closure, and a third means for injecting a flow of water is connected to at least one processing zone.

13. An industrial oven for heat treating a series of articles comprising claim 12 wherein the oven is provided with a process zone adjacent to the first air barrier closure and a second processing zone adjacent to the second air barrier closure, a second heating means operatively associated with the second processing zone, the third means for injecting a flow of water being operatively associated with the first heating means and injecting a flow of water into the first processing zone, and the exhaust port being disposed in the second processing zone.

14. An industrial oven for heat treating a series of articles comprising an enclosure having a tunnel disposed therein with an axis of elongation, said enclosure having a first opening adapted to receive articles for processing and communicating with the tunnel, said enclosure having an exhaust port spaced from the first opening and communicating with the tunnel, means operatively associated with the enclosure to heat the tunnel to a heat treating temperature, a first air barrier closure disposed within the tunnel confronting the first opening and disposed between the first opening and the means to heat the tunnel and the exhaust port, said first air barrier closure having a first blower with a first inlet for receiving a gaseous medium and a first nozzle for expelling the gaseous medium from the first blower in a flow and directing the medium flow across the tunnel, an exhaust blower communicating with the exhaust port for removing a portion of the gaseous medium from within the tunnel and reducing the pressure of the gaseous medium within the tunnel to a pressure below that of the ambient atmosphere exterior of the enclosure, and a second means including a source of water for providing a flow of water to the tunnel, whereby the atmosphere of the tunnel will include water vapor and have a significantly greater thermal capacity.

15. An industrial oven for heat treating a series of articles comprising claim 14 in combination with a first means for providing a flow of water to the first air barrier closure including the source of water, said first means for providing a flow of water to the first air barrier closure connecting the water source between the first inlet and the first nozzle.

16. An industrial oven for heat treating a series of articles comprising claim 15 wherein the enclosure has a pair of side walls substantially vertically disposed on opposite sides of the axis of elongation, a top wall disposed above the axis of elongation, and a bottom wall disposed below the axis of elongation, said enclosure also having a first and a second end wall disposed normal to the axis of elongation at opposite ends of the enclosure, the first opening of the enclosure being disposed in the first end wall, the first nozzle being mounted on the top wall and the first nozzle being directed downwardly across the tunnel at an acute angle to the plane of the first end wall, and the first inlet of the first air barrier closure being a first port in the top wall of the enclosure adjacent to the first nozzle and on the side thereof opposite the first end wall.

17. The method of heat treating a process article comprising the steps of heating the environment in an elongated tunnel in an enclosure to a temperature of at least 200 degrees Fahrenheit and suitable for treating the process article, transporting the article through an opening into the tunnel in the enclosure, providing within the tunnel a flow of a gaseous medium across the opening to reduce leakage from the tunnel through the opening in the enclosure, exhausting a portion of the gaseous environment within the tunnel to reduce the pressure of the gaseous environment within the tunnel to below that of the ambient atmosphere exterior of the enclosure, and heating the flow of gaseous medium across the opening to a temperature above the temperature of the interior of the tunnel.

18. The method of heat treating a process article comprising the steps of claim 17 and the step of injecting moisture into the tunnel to add super heated steam to the gaseous environment within the tunnel in order to increase the rate of heat transfer from the gaseous environment to the article.

19. The method of heat treating a process article comprising the steps of claim 17 and the step of injecting moisture into the flow of heated gaseous medium across the opening to produce steam within the flow in order to increase the rate of heat transfer from the flow of heated gaseous medium to the process article.

20. The method of heat curing an article laden with powdered paint comprising the steps of claim 19 wherein the temperature within the tunnel of the enclosure is maintained at a temperature of about 350 to 400 degrees Fahrenheit and the temperature of the flow of gaseous medium across the opening is at a temperature of 400 to 600 degrees Fahrenheit.

21. The method of heat treating a plurality of process articles comprising the steps of claim 17 wherein the process articles are removably mounted at equal distances on a conveyor which extends through the opening and into the enclosure, the conveyor extending through the tunnel of the enclosure and out of the enclosure through a second opening, transporting the articles on the conveyor through the tunnel and out of the enclosure at a constant rate, providing within the tunnel a flow of a gaseous medium across the second opening to reduce leakage from the tunnel through the second opening in the enclosure.

22. An industrial oven for heat treating a series of articles comprising an enclosure having a tunnel disposed therein with an axis of elongation, said enclosure having a first opening adapted to receive articles for processing and communicating with the tunnel, said enclosure having an exhaust port spaced from the first opening and communicating with the tunnel, means operatively associated with the enclosure to heat the tunnel to a heat treating temperature of at least 350 degrees Fahrenheit, a first air barrier closure disposed within the tunnel confronting the first opening and disposed between the first opening and the means to heat the tunnel and the exhaust port, said first air barrier closure having a first blower with a first inlet for receiving a gaseous medium and a first nozzle for expelling the gaseous medium from the first blower in a flow and directing the medium flow across the tunnel, said first blower having a first heater disposed between the first inlet and the first nozzle, the first heater being adapted to raise the temperature of the gaseous medium expelled through the first nozzle to at least 400 degrees Fahrenheit and above the temperature within the tunnel, and an exhaust blower communicating with the exhaust port for removing a portion of the gaseous medium from within the tunnel and reducing the pressure of the gaseous medium within the tunnel to a pressure below that of the ambient atmosphere exterior of the enclosure.

23. The method of heat treating a process article comprising the steps of heating the environment in an elongated tunnel in an enclosure to a temperature of at least 350 degrees Fahrenheit and suitable for treating the process article, transporting the article through an opening into the tunnel in the enclosure, providing within the tunnel a flow of a gaseous medium across the opening to reduce leakage from the tunnel through the opening in the enclosure, exhausting a portion of the gaseous environment within the tunnel to reduce the pressure of the gaseous environment within the tunnel to below that of the ambient atmosphere exterior of the enclosure, and heating the flow of gaseous medium across the opening to a temperature of at least 400 degrees Fahrenheit and above the temperature of the interior of the tunnel.

* * * * *